US010088167B2

(12) United States Patent
Mogle et al.

(10) Patent No.: US 10,088,167 B2
(45) Date of Patent: Oct. 2, 2018

(54) COMBUSTION FLOW SLEEVE LIFTING TOOL

(71) Applicant: General Electric Company, Schenectady, NY (US)

(72) Inventors: Thomas Alan Mogle, Greenville, SC (US); Wayne Sullivan, Greenville, SC (US)

(73) Assignee: General Electric Company, Schenectady, NY (US)

( * ) Notice: Subject to any disclaimer, the term of this patent is extended or adjusted under 35 U.S.C. 154(b) by 434 days.

(21) Appl. No.: 14/739,695

(22) Filed: Jun. 15, 2015

(65) Prior Publication Data

US 2016/0363323 A1 Dec. 15, 2016

(51) Int. Cl.

| | |
|---|---|
| ***F23R 3/60*** | (2006.01) |
| ***F01D 25/28*** | (2006.01) |
| ***F23R 3/44*** | (2006.01) |
| *B66C 1/10* | (2006.01) |

(52) U.S. Cl.

CPC ..... *F23R 3/60* (2013.01); *F01D 25/285* (2013.01); *F23R 3/44* (2013.01); *B66C 1/10* (2013.01); *F23R 2900/00017* (2013.01); *F23R 2900/00019* (2013.01)

(58) Field of Classification Search

CPC .. F01D 25/285; F23R 3/44; F23R 3/60; F23R 2900/00017; F23R 2900/00019

See application file for complete search history.

(56) References Cited

U.S. PATENT DOCUMENTS

| | | | | |
|---|---|---|---|---|
| 2,694,603 | A | 11/1954 | Griffin | |
| 3,048,280 | A | 8/1962 | Huff et al. | |
| 3,312,434 | A | 4/1967 | Simon | |
| 3,685,125 | A | 8/1972 | DePierre | |
| 3,696,496 | A | 10/1972 | Corder | |
| 4,004,333 | A | 1/1977 | Daniels | |
| 4,074,411 | A | 2/1978 | Willard et al. | |
| 4,528,735 | A | 7/1985 | Eastridge et al. | |
| 4,635,336 | A * | 1/1987 | Ades | B23P 11/025 29/252 |
| 4,908,925 | A | 3/1990 | Johnson | |
| 5,203,837 | A | 4/1993 | Madic et al. | |
| 5,274,991 | A | 1/1994 | Fitts | |
| 5,323,600 | A | 6/1994 | Munshi | |

(Continued)

OTHER PUBLICATIONS

Extended European Search Report and Opinion issued in connection with corresponding EP Application No. 16174222.6 dated Oct. 21, 2016.

*Primary Examiner* — Jacob Cigna
(74) *Attorney, Agent, or Firm* — Nixon & Vanderhye P.C.

(57) ABSTRACT

A flow sleeve removal tool including: a shaft having an axis; a bracket attached to the shaft including a ring configured to abut and be releasably attached to an end of a flow sleeve of a gas turbine engine; a shaft attached to the bracket and coaxial with a flow sleeve of a gas turbine engine; a counter balance attached to the shaft, and a cable connector mounted to the shaft between the counter balance and the flow sleeve, wherein the cable connector is configured to attach to a cable connected to an overhead support structure and the cable connector is at a position on the shaft at which the flow sleeve is substantially balances the counter weight.

20 Claims, 4 Drawing Sheets

(56) References Cited

U.S. PATENT DOCUMENTS 5,383,652 A * 1/1995 Van Den Berg ..... B25H 1/0007 269/17
6,141,862 A * 11/2000 Matsui ..... F01D 25/285 29/278
6,279,313 B1 8/2001 Lawen, Jr. et al.
6,345,441 B1 2/2002 Farmer et al.
6,578,892 B2 * 6/2003 Tsimmerman ..... B66C 1/105 294/67.21
6,886,584 B2 5/2005 Turvey
6,923,002 B2 8/2005 Crawley et al.
6,951,109 B2 10/2005 Lemon et al.
7,040,096 B2 5/2006 Manteiga et al.
7,086,232 B2 8/2006 Mortle et al.
7,093,440 B2 8/2006 Howell et al.
7,207,168 B2 4/2007 Doepker et al.
7,272,886 B2 9/2007 Thomson
7,360,364 B2 4/2008 Danis et al.
7,386,911 B2 6/2008 Stoll
7,493,767 B2 2/2009 Bunker et al.
7,836,569 B2 11/2010 Spaulding et al.
8,276,253 B2 10/2012 Herbold et al.
8,528,192 B2 9/2013 Jayko et al.
8,683,670 B2 4/2014 Thomas
8,713,776 B2 5/2014 Herbold
8,782,865 B2 * 7/2014 Gerengi ..... F01D 25/28 29/244
2007/0033795 A1 * 2/2007 McCaffrey ..... B66C 11/04 29/464
2011/0247193 A1 10/2011 Herbold
2012/0151735 A1 * 6/2012 Thomas ..... B25B 27/062 29/426.5
2012/0233845 A1 * 9/2012 Gerengi ..... F01D 25/28 29/466
2014/0215800 A1 8/2014 Griese et al.
2016/0263715 A1 * 9/2016 Gerber ..... B23P 19/042
2016/0265440 A1 * 9/2016 Jorgensen ..... F23R 3/60
2017/0167298 A1 * 6/2017 Kolvick ..... F01D 25/285

* cited by examiner

COMBUSTION FLOW SLEEVE LIFTING TOOL

BACKGROUND OF THE INVENTION

The invention relates to the removal and installation of combustion flow sleeves for a gas turbine engine. In particular, the invention relates to a tool to assist technicians remove and install combustion flow sleeves.

A combustion flow sleeves fits into each combustion "can" in a combustor for a gas turbine engine. The flow sleeve is typically cylindrical, slides into the housing of the combustion can and surrounds the combustion liner of the can.

The flow sleeve remains in a fixed position within the housing of the combustion can during operation of the gas turbine engine. The flow sleeve is removed or installed while the engine is shut down. To install or remove the flow sleeve, the sleeve is slid out of an opened end of the housing for the combustion can.

Removal of the flow sleeve was conventionally performed by technicians attaching brackets to the end of the sleeve and sliding the sleeve out from the casing of the gas turbine engine. The technicians may apply to the end of a flow sleeve a bracket, such as disclosed in U.S. Pat. No. 8,782,865. They push or pull on the bracket to insert or extract the flow sleeve. The bracket may connect to a lift that assists in supporting the bracket and flow sleeve.

BRIEF SUMMARY OF INVENTION

Flow sleeves for modern gas turbine engines tend to be heavier than those in earlier engines due to increases in size of the engines. The heavier flow sleeves are not easy to move manually into a combustion can of a gas turbine engine. Thus, there is a need for a tool to assist technicians to lift, install and remove flow sleeves.

Flow sleeve removal and installations are done at the site of an in-service gas turbine engine. Tools to assist in flow sleeve removal and installation are transported to the site or remain on site at all times. Tools that are heavy, bulky or expensive are not suited for flow sleeve installation or removal on site of the gas turbine engine. A flow sleeve installation tool has been conceived and is disclosed herein that is light, compact and inexpensive.

A flow sleeve installation tool should be maneuverable to align a flow sleeve with each of the combustion can locations around the circumference of a gas turbine engine. The orientation of each combustion can depends on its position on the gas turbine. The angle and position for flow sleeve varies with each combustion can location. A flow sleeve installation tool has been conceived and is disclosed herein that is easily moved into angular alignment with each combustion can of a gas turbine engine.

A flow sleeve removal tool has been conceived and is disclosed herein including: a shaft having an axis; a bracket attached to a first end region of the shaft, wherein the bracket includes a ring in a plane perpendicular to the axis of the shaft and a mount at the center of the bracket configured to receive the end region of the shaft, and wherein the ring is configured to abut and be releasably attached to an end of a flow sleeve of a gas turbine engine; a counter balance to the flow sleeve, wherein the counter balance is attached to a second end region of the shaft, and a cable connector mounted to the shaft between the counter balance and the flow sleeve, wherein the cable connector is configured to attach to a cable connected to an overhead support structure and the cable connector is at a position on the shaft at which the flow sleeve is substantially balances the counter weight, wherein an axis of the flow sleeve is coaxial with the axis of the shaft while the flow sleeve is attached to the bracket.

The shaft may be a hollow metal rod and include a handle on the end of the shaft proximate to the counter balance. The mount for the cable may be a slidable collar on the shaft. A second cable connector may be mounted to the shaft, wherein a second cable is attached to the second cable connector and the overhead support structure to hold the shaft and flow sleeve in a certain angular position with respect to a horizontal plane.

A flow sleeve removal tool and flow sleeve assembly comprising: a flow sleeve of a combustion can of a gas turbine engine, and a flow sleeve removal tool including: a shaft having an axis; a bracket attached to a first end region of the shaft, wherein the bracket includes a ring in a plane perpendicular to the axis of the shaft and a mount at the center of the bracket configured to receive the end region of the shaft, and wherein the ring is configured to abut and be releasably attached to an end of the flow sleeve; a counter balance to the flow sleeve, wherein the counter balance is attached to a second end region of the shaft, and a cable connector mounted to the shaft between the counter balance and the flow sleeve, wherein the cable connector is configured to attach to a cable connected to an overhead lift and the cable connector is at a position on the shaft at which the flow sleeve is substantially balances the counter weight, wherein an axis of the flow sleeve is coaxial with the axis of the shaft while the flow sleeve is attached to the bracket.

A method has been conceived and is disclosed herein for inserting or removing a flow sleeve into or from a casing of a gas turbine engine, the method comprising: attaching a bracket of a flow sleeve installation tool to an end of the flow sleeve; aligning an axis of a shaft of the flow sleeve installation tool with an axis of the flow sleeve, wherein the shaft is attached to the bracket; attaching a cable connector coupled to the shaft to a cable supported by an overhead support structure; arranging the cable connector and a counterweight on the shaft such that the counterweight and flow sleeve are substantially balanced about the cable connector;

maneuvering the shaft to move the axes of the shaft and the flow sleeve to be parallel to an axis of the opening in the casing configured to receive the flow sleeve, and after the maneuvering the shaft, sliding the flow sleeve with respect to the opening in the casing.

DETAILED DESCRIPTION OF THE INVENTION

Figure 1:
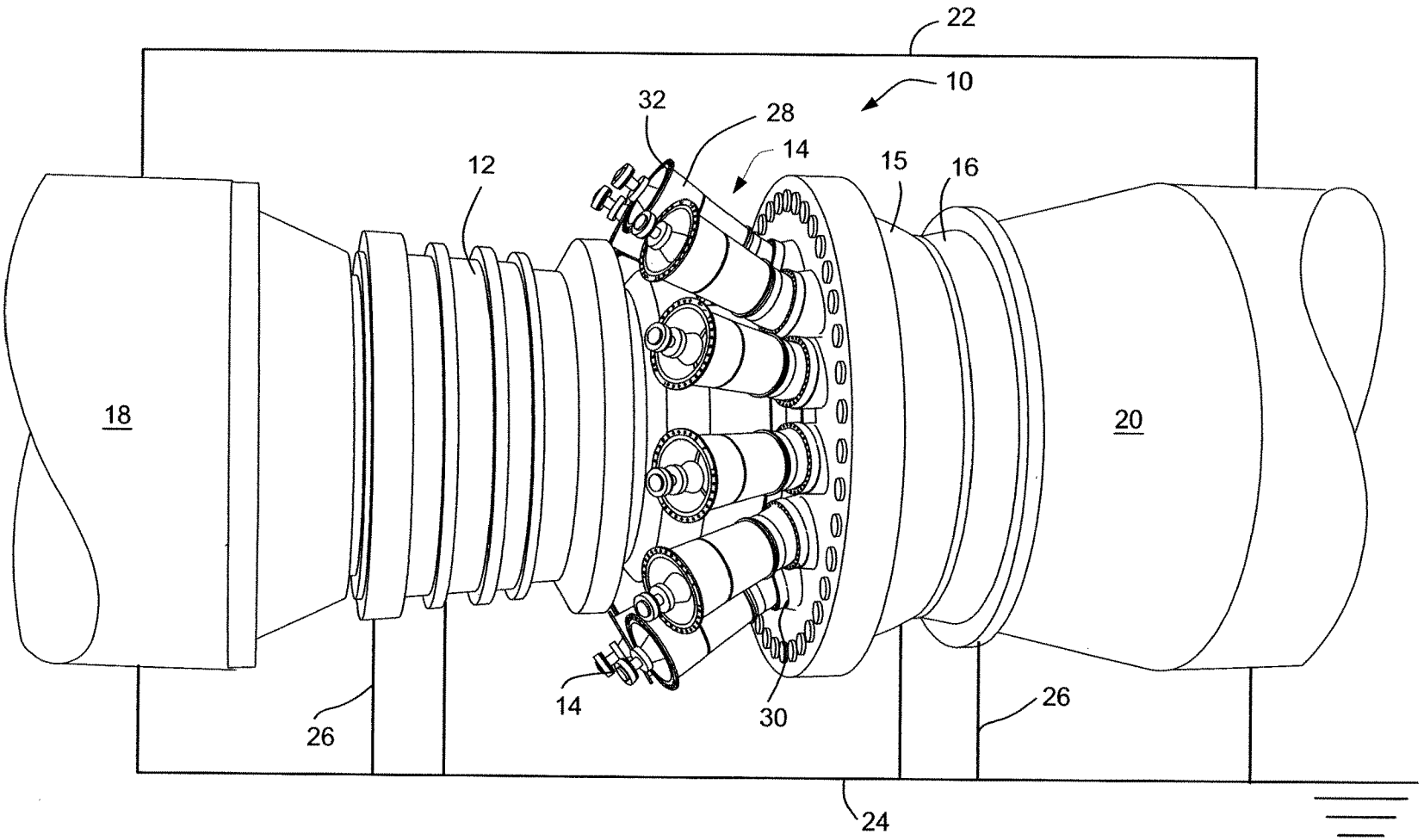
FIG. 1 is a side view of an industrial gas turbine engine with combustion cans.

FIG. 1 shows an industrial gas turbine engine 10 which includes a compressor 12, combustion cans 14 and a turbine 16. The combustion cans 14 are each attached to an opening 33 on the casing 15 for the gas turbine engine. The combustion cans are arranged in a circular array around a center portion of the casing.

Air enters the compressor through an intake duct 18. Compressed air exits the compressor and is mixed with fuel in each of the combustion cans 14 wherein the mixture combusts and forms hot combustion gases which rotate the turbine 16. The turbine drives the compressor to compress the air and produces power used to generate electricity or perform other work. Combustion gas exhausted from the turbine flows through an exhaust duct 20.

The industrial gas turbine engine 10 is enclosed in a housing 22. The gas turbine sits on a concrete pad 24 or other support platform, and is supported by support brackets 26 between the pad and the gas turbine engine. An air filter housing and ducts is typically in front of the gas turbine engine and an exhaust duct housing is behind the engine. The area around a gas turbine engine may be limited due to the pad, support brackets and ducts. Tools used to remove and install flow sleeves should be compact to work in the confined space around the gas turbine engine.

Figure 2:
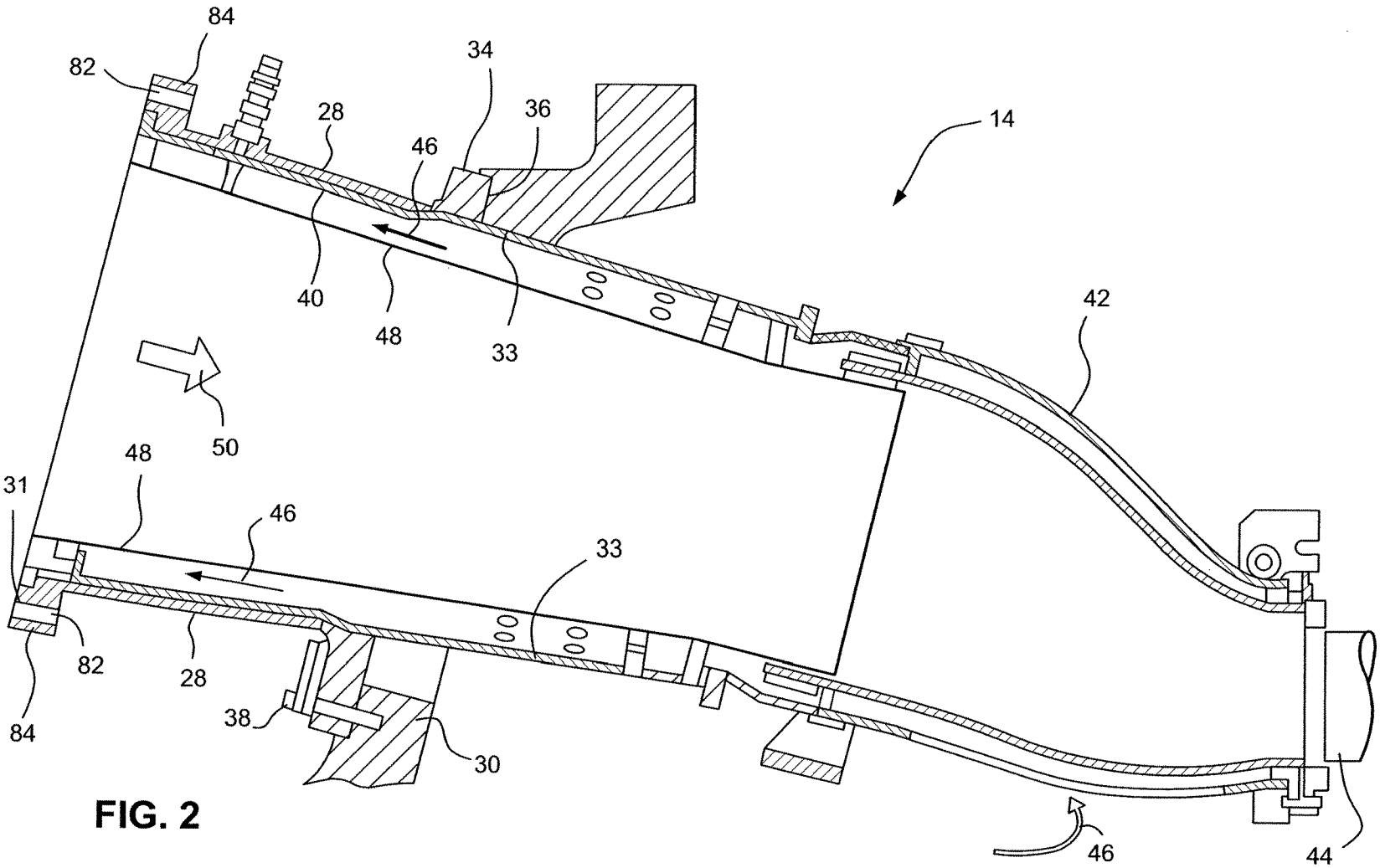
FIG. 2 is a cross sectional view of an exemplary combustion can.
Figure 3:
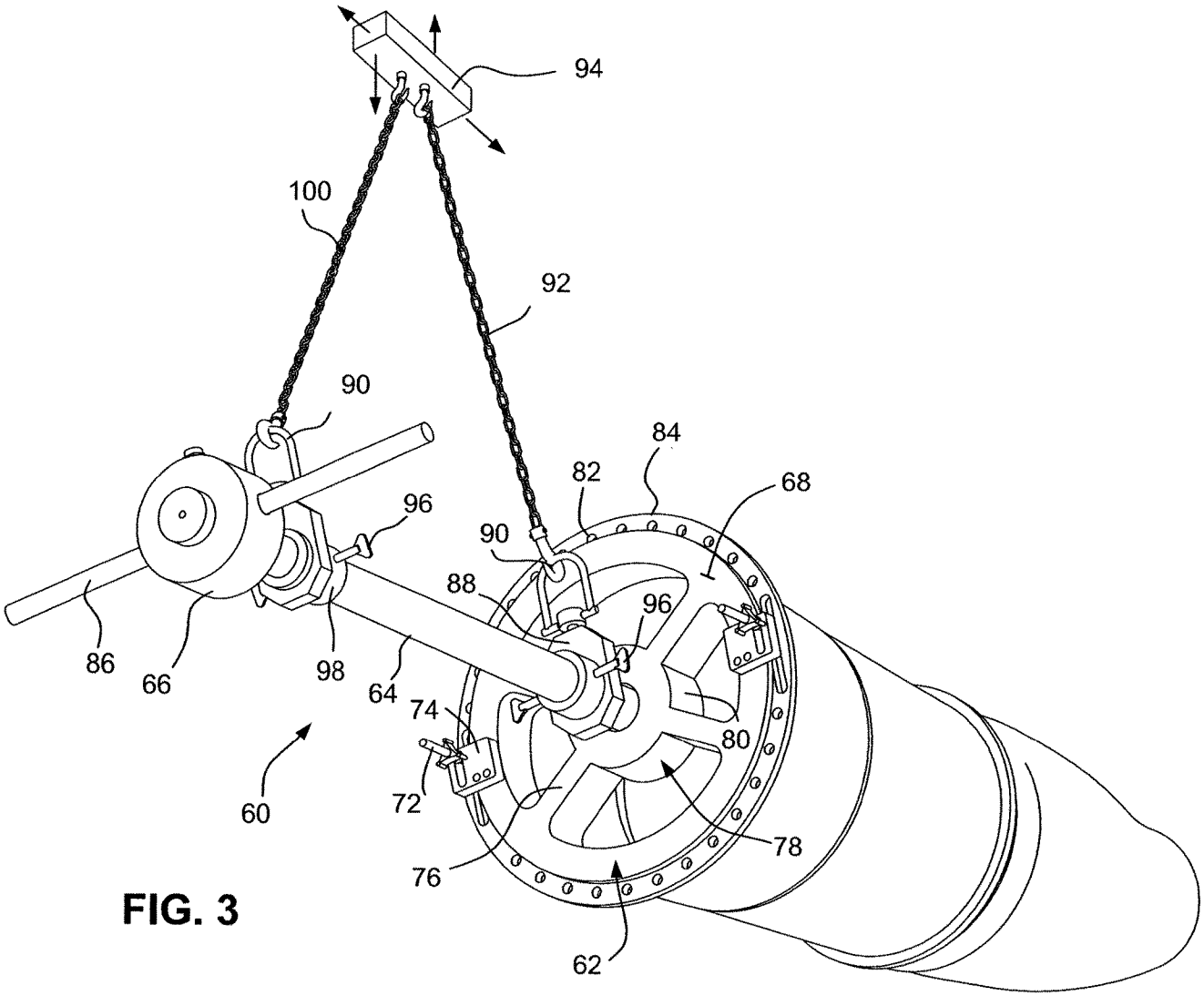
FIG. 3 is a side view of a flow sleeve extraction tool.

FIG. 2 is a cross-sectional side view of a combustion can 14 that includes a substantially cylindrical metal housing 28 secured to an annular flange section 30 of the casing 15 for the gas turbine engine. The combustion can 14 extends radially and axially outward from the casing. Each can has a different position on the perimeter of the casing. A cap 32 on the outer end 31 of the combustion can supports couplings to fuel conduits. The cap 32 is shown in FIG. 1 but not FIG. 2. The cap is removed before the flow sleeve is removed.

The end of the housing 28 opposite to the cap is fastened to an annular flange section 30 of the casing 15. The annular flange section includes openings 33 that align with the open end of the housing. An annular flange 34 on the end of the housing seats on a ring surface 36 around the opening of the flange 30 of the casing. Bolts 38 extend through the flanges 30, 34 to secure the housing 38 to the casing.

The housing 28 is fitted to the flange 30 after a flow sleeve 40 is inserted into the opening 33 of the casing. The housing slides over the flow sleeve.

The flow sleeve is a generally cylindrical metal tube formed of thin sheet metal. The flow sleeve 40 extends from the outer end 31 of the housing 28 to a transition duct 42. The duct 42 directs combustion gas to a first stage 44 of the turbine.

The flow sleeve has openings to allow compressed air 46 from the compressor to pass through the flow sleeve and enter an annular passage between the flow sleeve and a combustion liner 48. The flow liner 48 is a generally cylindrical tube that is within and coaxial with the flow sleeve. Compressed air and fuel mix within the flow liner to form combustion gases 50 that flow through the transition duct 42 to the first stage 44 of the turbine.

The flow sleeve is generally about one and a half feet to three feet (0.5 to 1 meter(m)) in diameter and three to five feet (1 m to 1.5 m) in length. The weight of the flow sleeves is typically in a range of 60 to 200 pounds (0.5 to 2.8 kilograms (kg)). The size and weight of a flow sleeve are such that they may be installed and removed manually with the aid of tools.

A flow sleeve installation and removal tool 60 has been inverted that includes a bracket 62 supported at one end of a shaft 64 and a counter weight 66 at on opposite end of the shaft. The bracket attaches to an end 31 (FIG. 2) of a flow sleeve. The bracket may include a ring 68 with holes to receive fasteners, e.g. bolts 72, that secure a clamp 74 to the ring. The ring is in a plane perpendicular to the axes of the shaft and flow sleeve.

The clamp attaches the ring to the end 31 of the flow sleeve. Spokes 76 on the bracket connect the ring 68 to a center disc 78 which has a cylindrical recess 80 to receive an end of the shaft 64. The recess 80 may be at the center of the ring and the bracket 62. The recess may be threaded to receive and engage threads on the end of the shaft.

The bolt 72 for each clamp 74 may be include a threaded end configured to engage a hole 82 (FIG. 2) on an outer annular flange 84 of the flow sleeve. The bolt 72 extends through a hole 70 in the clamp and screws into the hole 82 of the flange. The blot may be tightened manually. The bolts and clamp secure the bracket 62 to the end 31 of the flow sleeve.

The shaft 64 may be a hollow metal pipe having a length of two to five feet (0.6 m to 1.5 m). The thickness and strength of the shaft is sufficient to support a flow sleeve at one end of the shaft.

The end of the shaft opposite to the bracket may include a handle 86. The handle is configured to be held by the hands of a technician installing the flow sleeve. By manipulating the handle and the shaft, the technician moves the flow sleeve from a floor to the openings in the casing for the flow sleeve. Similarly, the handle is used by the technician to slide the flow sleeve out of the casing and position the removed flow sleeve on the floor.

A counter weight 66 is on the shaft 64 near the handle 86. The counter weight balances the flow sleeve mounted to the installation tool. The counter weight may have a mass (weight) substantially the same as the weight of the flow sleeve. For example, the mass of the counter weight may be 80 percent to 120 percent of the mass of the flow sleeve. The mass of the counter weight may be adjustable by adding or removing mass to the counter weight. The counter weight may also slide to different positions on the shaft to improve its function as a counter-balance to the flow sleeve. Once slid to the proper position, the counter weight is fixed to the shaft, such as by a thumb screw that extends from the counter weight and binds against the shaft.

A slidable collar 88 on the shaft includes a hook or other cable connection 90 to receive a cable 92, such as a chain or rope, that is attached to an overhead lift 94, such as a crane or winch. The collar 88 forms a pivot about which the flow sleeve may be tilted and moved while attached to the flow sleeve installation tool. The collar may be slid along the shaft 64 such that the flow sleeve is balanced about the pivot by the counter weight 66. A thumb screw 96 may secure the collar to the shaft to hold the collar at a desired position on the shaft and preventing the collar from sliding while the flow sleeve is being maneuvered.

The overhead lift 94 may be movable in horizontal and vertical directions to move the flow sleeve installation tool and flow sleeve during the removal or installation of the flow sleeve.

A second collar 98 on the shaft may be positioned proximate to the counter weight. The second collar may be connected to the lift (or to a second lift) by a second cable 100. The technician will determine whether to connect either or both of the collars 88, 98 to the lift depending on the circumstances of each installation or removal of a flow sleeve.

Figure 4:
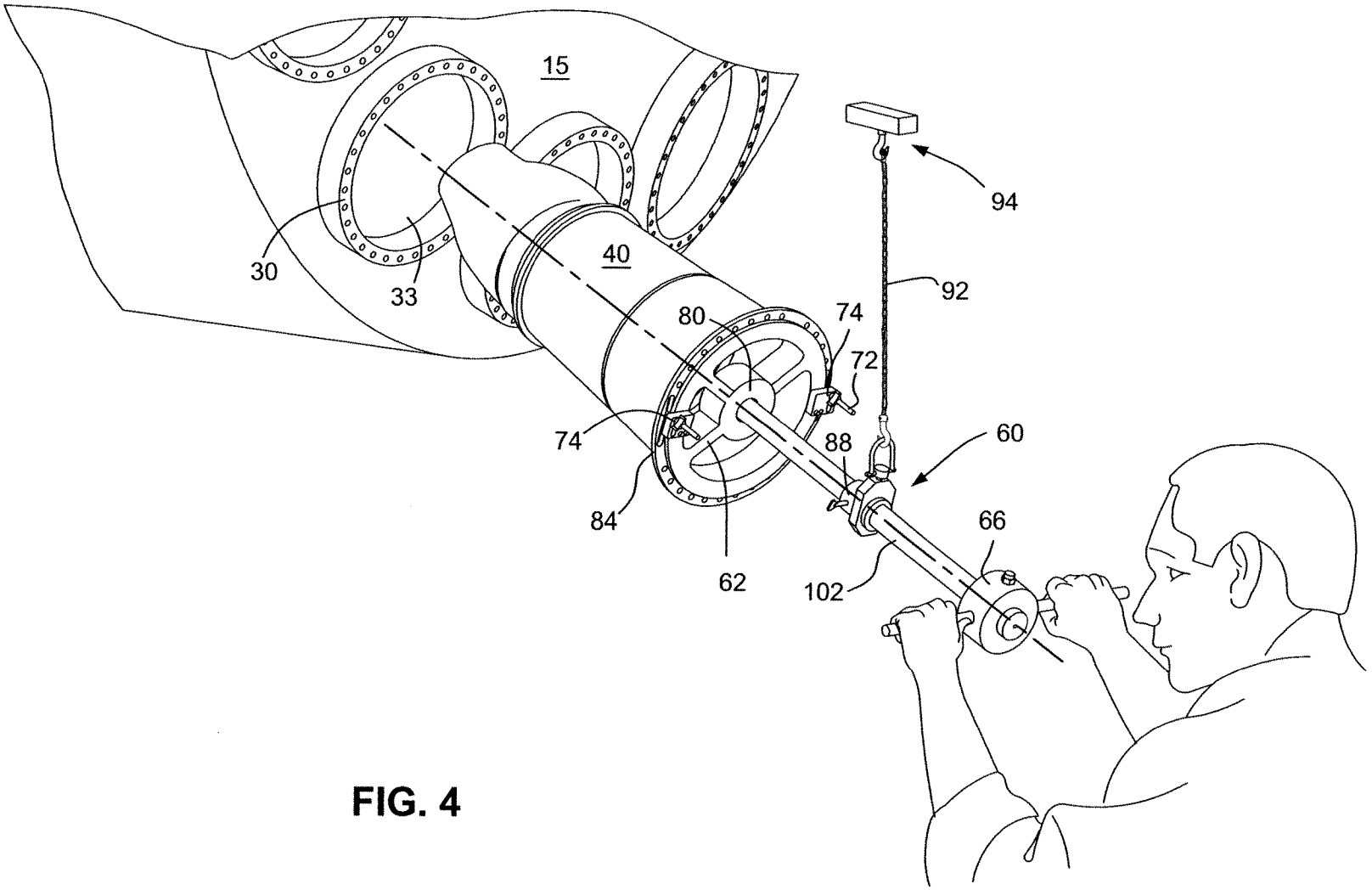
FIG. 4 is a perspective view of the flow sleeve extraction tool extracting a combustion flow sleeve.

FIG. 4 illustrates a flow sleeve 40 being installed into an opening 33 for a combustion can in the casing 15 of a gas turbine engine. The annular bracket 62 of the flow sleeve installation tool is attached to the annular flange 84 at the outer end of the flow sleeve 40. Clamps 74 secure the bracket to the flange.

The end of the shaft 64 of the flow sleeve installation tool 60 is inserted and attached to the center disc 78 of the bracket 62 of the tool. When attached to the bracket and the bracket is attached to the flow sleeve, the shaft 64 is aligned, i.e., coaxial, with the axis 102 of the flow sleeve. The alignment assists in balancing the counter weight 66 and the flow sleeve.

By balancing the flow sleeve and the counter weight, the flow sleeve and counter weight can be supported at the collar 88 by the cable 92 and the overhead lift 94. The balance allows the flow sleeve to be easily pivoted about the collar 88 by a technician moving the handle 86.

By pivoting the flow sleeve 40 about the collar 88, the flow sleeve can be moved to an angular position that is parallel to an axis 102 of the combustion can that is to receive the flow sleeve. The flow sleeve may be moved in horizontal and vertical directions by moving the overhead lift 94. By moving the overhead lift and using the handle 86 to pivot the flow sleeve installation tool 60, the flow sleeve 40 can be moved into alignment with the opening 33 to receive the flow sleeve.

Once the flow sleeve installation tool 60 has been manipulated to align the flow sleeve 40 with the opening 33, a second cable 92 may be attached to the second collar 98 and the overhead lift. By attaching the second cable, the angular position with respect to a horizontal plane can be fixed to hold the flow sleeve in angular alignment with the opening of the turbine casing.

Once the flow sleeve is aligned with the opening of the turbine casing, the flow sleeve may be inserted into the opening 33 by releasing the thumb screw on the collar 88 and allowing the shaft 64 to slide with respect to the collar. As the shaft slides through the collar, the flow sleeve slides into the opening 33 of the gas turbine engine. Similarly, a flow sleeve can be removed after the flow installation tool is attached by allowing the shaft to slide through the collar as the flow sleeve slides out of the casing. In addition to sliding laterally, the shaft may rotate with respect to the collar to cause the flow sleeve to rotate as it slides in or out of the turbine casing.

The flow sleeve installation tool 60 is a safe, compact and inexpensive. The tool allows the weight of the flow sleeve 40 to be borne by an overhead lift in a manner than allows the sleeve to be pivoted up, down and sideways. The pivoting enables a technician to easily place the flow sleeve at an angle aligned with an axis of a combustion can.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A flow sleeve removal tool comprising:

a shaft having an axis;

a bracket attached to a first end region of the shaft, wherein the bracket includes a ring in a plane perpendicular to the axis of the shaft and a mount at the center of the bracket configured to receive the end region of the shaft, and wherein the ring is configured to abut and be releasably attached to an end of a flow sleeve of a gas turbine engine;

a counter balance to the flow sleeve, wherein the counter balance is attached to a second end region of the shaft, and a cable connector mounted to the shaft between the counter balance and the flow sleeve, wherein the cable connector is configured to attach to a cable connected to an overhead support structure and the cable connector is at a position on the shaft at which the flow sleeve substantially balances the counter weight and is aligned with a vertical axis of the cable, wherein an axis of the flow sleeve is coaxial with the axis of the shaft while the flow sleeve is attached to the bracket.

2. The flow sleeve removal tool of claim 1 wherein the shaft is a hollow metal rod.

3. The flow sleeve removal tool of claim 1 further comprising a handle on the shaft proximate to the counter balance.

4. The flow sleeve removal tool of claim 1 further comprising a slidable collar on the shaft and the slidable collar is a mount for the cable connector to the shaft.

5. The flow sleeve removal tool of claim 1 further comprising a second cable connector mounted to the shaft, wherein a second cable is attached to the second cable connector and the overhead support structure to hold the shaft and flow sleeve in a certain angular position with respect to a horizontal plane.

6. The flow sleeve removal tool of claim 1 further comprising clamps attached to the ring and releasably attachable to the flow sleeve.

7. The flow sleeve removal tool of claim 1 wherein the overhead support structure is an overhead lift configured to move in a horizontal plane or a vertical direction.

8. The flow sleeve of claim 1 wherein the cable connector is configured to form a pivoting joint about which the shaft and flow sleeve pivots.

9. A flow sleeve removal tool and flow sleeve assembly comprising:

a flow sleeve of a combustion can of a gas turbine engine, and a flow sleeve removal tool including:

a shaft having an axis;

a bracket attached to a first end region of the shaft, wherein the bracket includes a ring in a plane perpendicular to the axis of the shaft and a mount at the center of the bracket configured to receive the end region of the shaft, and wherein the ring is configured to abut and be releasably attached to an end of the flow sleeve;

a counter balance to the flow sleeve, wherein the counter balance is attached to a second end region of the shaft, and a cable connector mounted to the shaft between the counter balance and the flow sleeve, wherein the cable connector is configured to attach to a cable connected to an overhead lift and the cable connector is at a position on the shaft at which the flow sleeve substantially balances the counter weight and aligned along a vertical axis of the cable;

wherein an axis of the flow sleeve is coaxial with the axis of the shaft while the flow sleeve is attached to the bracket.

10. The flow sleeve removal tool and flow sleeve assembly of claim 9 wherein the shaft is a hollow metal rod.

11. The flow sleeve removal tool and flow sleeve assembly of claim 9 further comprising a handle on the shaft proximate to the counter balance.

12. The flow sleeve removal tool and flow sleeve assembly of claim 9 further comprising a slidable collar on the shaft and the slidable collar is a mount for the cable connector to the shaft.

13. The flow sleeve removal tool and flow sleeve assembly of claim 9 further comprising a second cable connector mounted to the shaft, wherein a second cable is attached to the second cable connector and the overhead lift to hold the shaft and flow sleeve in a certain angular position with respect to a horizontal plane.

14. The flow sleeve removal tool and flow sleeve assembly of claim 9 further comprising clamps attached to the ring and releasably attachable to the flow sleeve.

15. The flow sleeve removal tool and flow sleeve assembly of claim 9 wherein the shaft and flow sleeve pivot an attachment between the cable and cable connector.

16. A method for inserting or removing a flow sleeve into or from a casing of a gas turbine engine, the method comprising:

attaching a ring of a bracket of a flow sleeve installation tool to an end of the flow sleeve;

aligning an axis of a shaft of the flow sleeve installation tool with an axis of the flow sleeve, wherein the shaft is attached to the bracket and the shaft is perpendicular to the ring;

attaching a cable connector coupled to the shaft to a cable supported by an overhead support structure, wherein the cable connector is aligned with a vertical axis of the cable;

arranging the cable connector and a counterweight on the shaft such that the counterweight and flow sleeve are substantially balanced about the cable connector;

maneuvering the shaft to move the axes of the shaft and the flow sleeve to be parallel to an axis of the opening in the casing configured to receive the flow sleeve, and after the maneuvering the shaft, sliding the flow sleeve with respect to the opening in the casing.

17. The method of claim 16 wherein the maneuvering of the shaft includes moving the flow sleeve installation tool and the flow sleeve vertically or horizontally.

18. The method of claim 16 wherein the arranging of the cable connector and the counterweight includes sliding the shaft with respect to the cable connector to substantially balance the flow sleeve and the counterweight.

19. The method of claim 16 further comprising attaching a second cable connector to a second cable supported by the overhead support structure, wherein the second cable connector is coupled to the shaft, and the attaching of the second cable connector to the second cable holds the axes of the flow sleeve and the shaft in parallel alignment with the opening.

20. The method of claim 16 wherein the step of maneuvering includes pivoting the flow sleeve and shaft about the cable connector.

* * * * *